US008221091B2

(12) United States Patent
Kim et al.

(10) Patent No.: US 8,221,091 B2
(45) Date of Patent: Jul. 17, 2012

(54) DRIVING CONTROLLING APPARATUS FOR RECIPROCATING COMPRESSOR AND METHOD THEREOF

(75) Inventors: Hyeung-Ju Kim, Seoul (KR); Chang-Oh Kim, Gyeonggi-Do (KR); Chel-Woong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1115 days.

(21) Appl. No.: 12/091,920

(22) PCT Filed: Oct. 20, 2006

(86) PCT No.: PCT/KR2006/004288

§ 371 (c)(1),
(2), (4) Date: Apr. 28, 2008

(87) PCT Pub. No.: WO2007/052909

PCT Pub. Date: May 10, 2007

(65) Prior Publication Data

US 2008/0292475 A1 Nov. 27, 2008

(30) Foreign Application Priority Data

Oct. 31, 2005 (KR) ..... 10-2005-0103566

(51) Int. Cl.
*F04B 49/06* (2006.01)

(52) U.S. Cl. ..... 417/44.11; 417/12; 417/417; 318/471

(58) Field of Classification Search ..... 417/417, 417/12, 44.11; 318/471; 62/156, 157, 163, 62/166, 168, 176.3, 215, 401
See application file for complete search history.

(56) References Cited

U.S. PATENT DOCUMENTS

| | | | | |
|---|---|---|---|---|
| 4,562,313 | A * | 12/1985 | Tomlinson et al. | 379/29.01 |
| 5,451,853 | A * | 9/1995 | Itoh | 318/788 |
| 6,947,271 | B1 * | 9/2005 | Gronowicz, Jr. | 361/93.1 |
| 2004/0080287 | A1 * | 4/2004 | Park | 318/124 |
| 2005/0053471 | A1 * | 3/2005 | Hong et al. | 417/44.11 |
| 2005/0152788 | A1 | 7/2005 | Hong et al. | |
| 2005/0184687 | A1 * | 8/2005 | Hong et al. | 318/66 |

FOREIGN PATENT DOCUMENTS

KR 10-2005-0082884 A 8/2005

* cited by examiner

*Primary Examiner* — Devon Kramer
*Assistant Examiner* — Thomas Fink
(74) *Attorney, Agent, or Firm* — Birch, Stewart, Kolasch & Birch, LLP

(57) ABSTRACT

Driving controlling apparatus and method for a reciprocating compressor capable of stably driving a reciprocating compressor when a reciprocating compressor is operated or an output capacity of the reciprocating compressor is varied, by matching an impedance of the apparatus to an inductance of a motor, and capable of enhancing an efficiency of the reciprocating compressor. The apparatus comprises an output capacity determining unit for determining an output capacity of a reciprocating compressor; an over-stroke preventing unit for preventing an over-stroke of a motor inside the reciprocating compressor; and an impedance matching unit for matching an inductance of the reciprocating compressor to an impedance of the apparatus.

11 Claims, 3 Drawing Sheets

Prior Art
[Fig. 1]
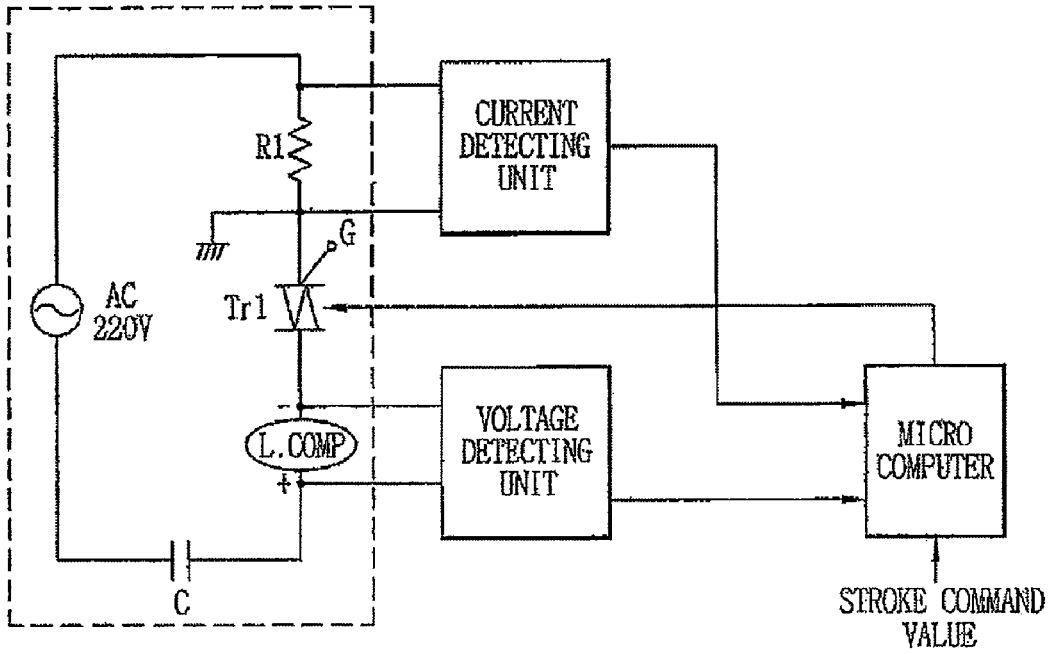
Prior Art
[Fig. 2]
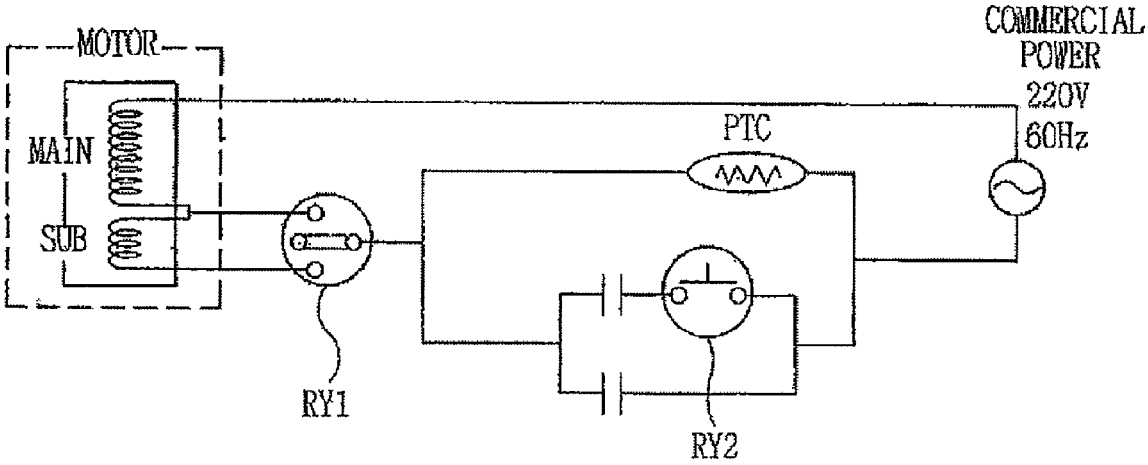

[Fig. 3]
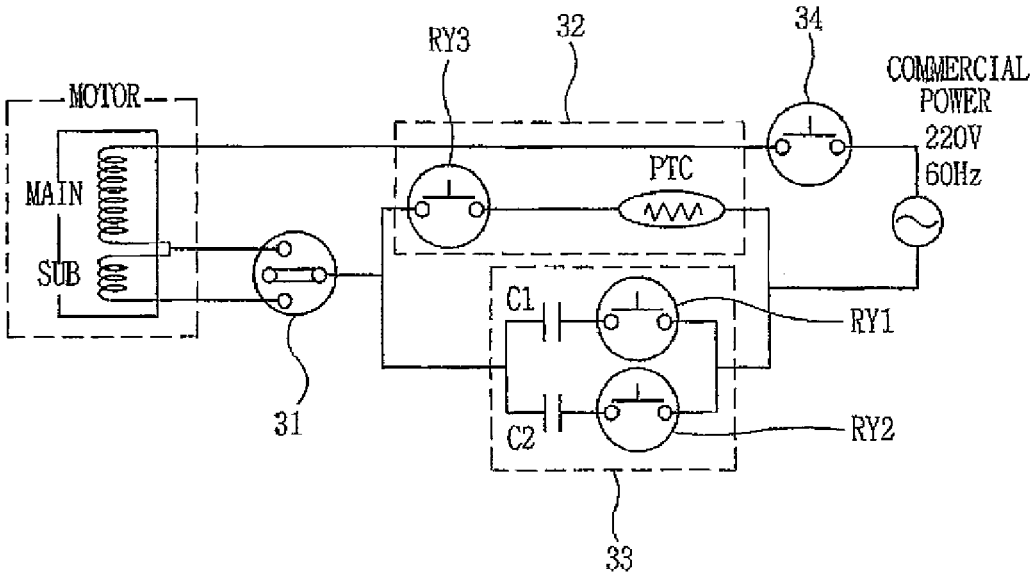
[Fig. 4]
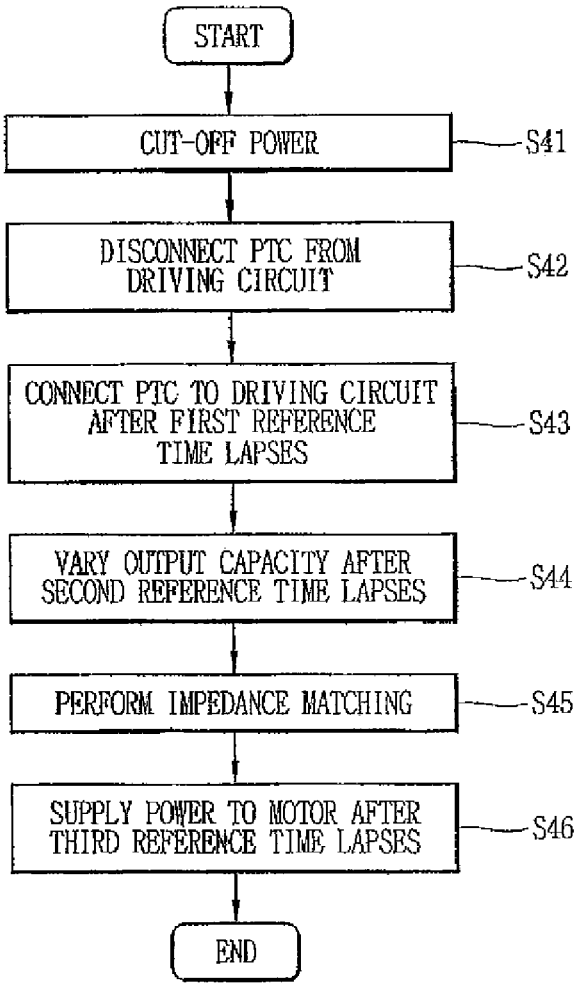

[Fig. 5]
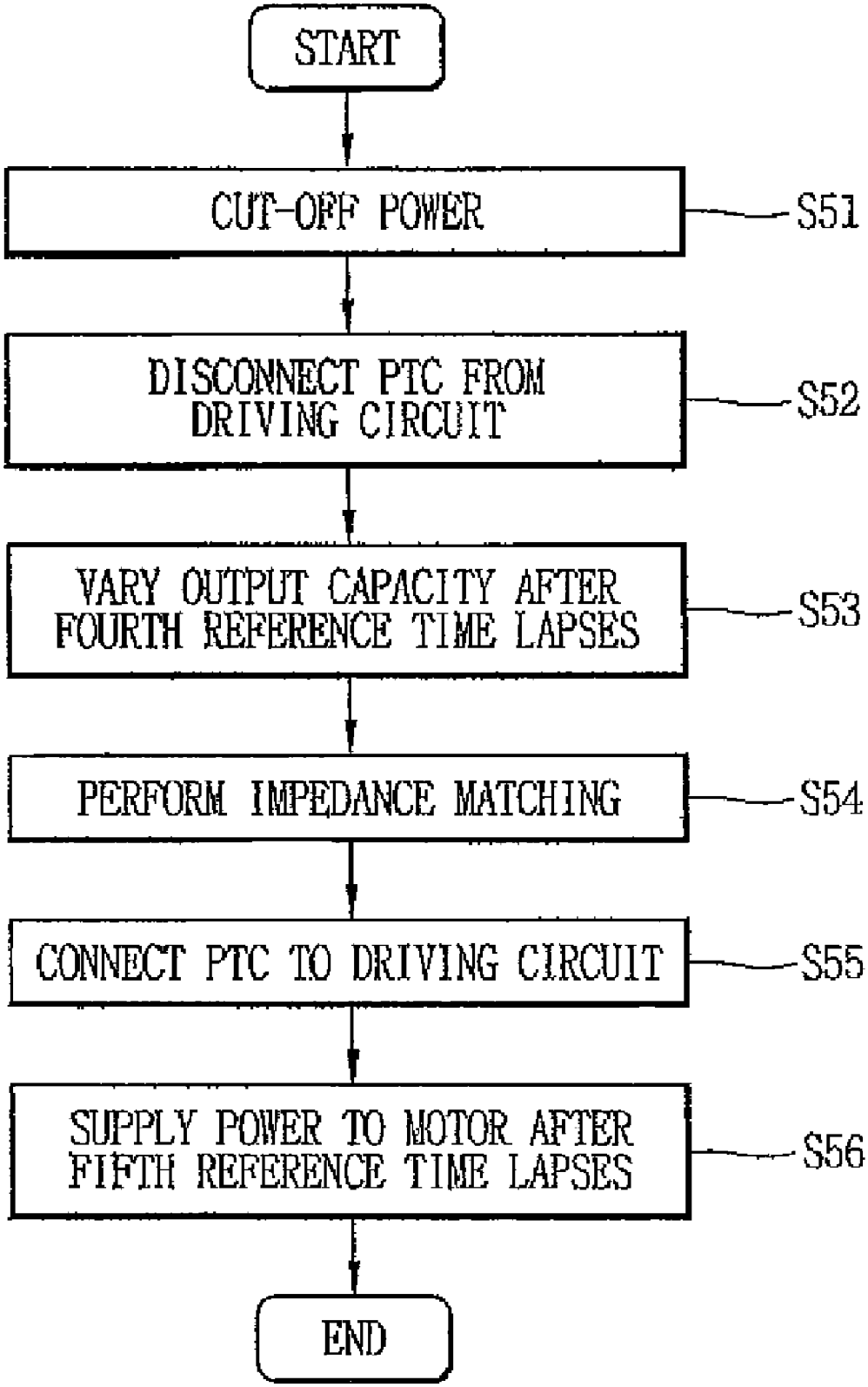

DRIVING CONTROLLING APPARATUS FOR RECIPROCATING COMPRESSOR AND METHOD THEREOF

TECHNICAL FIELD

The present invention relates to a driving controlling apparatus for a reciprocating compressor and a method thereof and more particularly, to a driving controlling apparatus for a reciprocating compressor capable of stably driving a reciprocating compressor at the time of varying an output capacity of the reciprocating compressor and capable of enhancing an efficiency of the reciprocating compressor, and a method thereof.

BACKGROUND ART

Generally, a reciprocating compressor can vary a compression capacity thereof by varying a voltage applied to a motor therein and thus by varying a compression ratio thereof.

The reciprocating compressor will be explained with reference to FIG. 1.

FIG. 1 is a block diagram showing a driving controlling apparatus for a reciprocating compressor in accordance with the prior art.

As shown in FIG. 1, the prior art reciprocating compressor is supplied with a voltage to control a stroke of a motor (not shown) therein by cutting off an input power (AC 220V) by controlling ON/OFF of a triac.

The motor inside the reciprocating compressor is wound by a coil with a uniform winding ratio. The reciprocating compressor is driven by the voltage to control the stroke.

The reciprocating compressor is supplied with a voltage to control the stroke by a switching operation of the triac. A mechanism for supplying the voltage to control the stroke generates noise, and thus an additional device for removing the noise is required.

To end this, a driving controlling apparatus for a reciprocating compressor capable of driving a motor by directly applying a commercial power to the reciprocating compressor has been proposed according to another embodiment of the prior art. In the driving controlling apparatus for a reciprocating compressor, a winding ratio of a coil of the motor of the reciprocating compressor is varied, and thus a capacitance is varied so as to enhance an efficiency of the reciprocating compressor.

A driving circuit of the reciprocating compressor according to another embodiment of the prior art will be explained with reference to FIG. 2.

FIG. 2 is a driving circuit of a reciprocating compressor according to another embodiment of the prior art.

A motor M inside the reciprocating compressor according to another embodiment of the present invention is provided with a main coil and a sub coil. A capacity of the motor is varied by selecting the main coil or both the main coil and the sub coil according to a load variation.

The selection of the coil will be explained. When a current load applied to the reciprocating compressor is larger than a reference load (over-load), a first relay (RY1) is switched so as to select only the main coil. As the result a constant of a counter electromotive force of the motor becomes small, a second relay (RY2) is closed, and a first capacitor (C1) and a second capacitor (C2) are connected in parallel with each other.

When a commercial power is applied to the reciprocating compressor, a current applied to the reciprocating compressor and a stroke of the motor inside the reciprocating compressor are increased. Accordingly, an output capacity of the reciprocating compressor is increased.

On the contrary, when a load applied to the reciprocating compressor is smaller than the reference load (low-load), the first relay (RY1) is switched so as to select both the main coil and the sub coil. As the result, the constant of the counter electromotive force of the motor becomes large, the second relay (RY2) is opened, and only the second capacitor (C2) is connected to the motor.

When a commercial power is applied to the reciprocating compressor, a current applied to the reciprocating compressor and a stroke of the motor inside the reciprocating compressor are decreased. Accordingly, an output capacity of the reciprocating compressor is decreased.

The number of windings (N) of the coil of the motor (M) inside the reciprocating compressor is proportional to the constant of the counter electromotive force of the motor (M), but is inversely-proportional to the stroke of the motor (M), which will be explained in the following formula 1.

$$\text{Stroke} \cong \frac{\text{Voltage}}{\text{Motor Constant}} \propto \frac{\text{Voltage}}{N} \qquad \text{[Formula 1]}$$

Herein, the number of windings N of the coil of the motor inside the reciprocating compressor is varied according to a load by a micro computer (not shown) so as to vary an output capacity of the reciprocating compressor.

When a commercial power is directly applied to the reciprocating compressor so as to drive the motor, the stroke of the motor inside the reciprocating compressor is drastically increased. In order to solve the problem, a PTC device was connected between the commercial power and the reciprocating compressor according to another embodiment of the prior art.

DISCLOSURE OF INVENTION

Technical Problem

In the reciprocating compressor according to another embodiment of the prior art, when the first relay, the second relay, and the PTC device are simultaneously connected to one another, a rush current flows on a driving circuit. Accordingly, an electric impact is applied to each component or the relay and the PTC device when adhered to each other, thereby degrading a reliability of a product.

Technical Solution

Therefore, an object of the present invention is to provide a driving controlling apparatus for a reciprocating compressor capable of stably driving a reciprocating compressor by matching an impedance thereof to an inductance of a motor of the reciprocating compressor at the time of varying an output capacity of the reciprocating compressor, capable of enhancing a reliability of a product, and capable of enhancing an efficiency of the reciprocating compressor, and a method thereof.

To achieve these and other advantages and in accordance with the purpose of the present invention, as embodied and broadly described herein, there is provided a driving controlling apparatus for a reciprocating compressor, comprising: an output capacity determining unit for determining an output capacity of a reciprocating compressor; an over-stroke preventing unit for preventing an over-stroke of a motor inside the reciprocating compressor; and an impedance matching unit for matching an inductance of the reciprocating compressor to an impedance of the apparatus, the inductance determined according to the output capacity determining unit.

To achieve these and other advantages and in accordance with the purpose of the present invention, as embodied and broadly described herein, there is also provided a driving controlling method for a reciprocating compressor, comprising: cutting off power supplied to a motor of a reciprocating compressor; preventing an over-stroke generated from the motor of the reciprocating compressor; varying an output capacity of the reciprocating compressor; matching an impedance of a driving controlling apparatus to an inductance of the motor so as to match to the varied output capacity; and supplying power to the power cut-off motor.

According to another embodiment of the present invention, the driving controlling method for a reciprocating compressor comprises: cutting off power supplied to a motor of a reciprocating compressor; firstly preventing an over-stroke generated from the motor of the reciprocating compressor; varying an output capacity of the reciprocating compressor; matching an impedance of a driving controlling apparatus to an inductance of the motor so as to match to the varied output capacity; secondly preventing an over-stroke generated from the motor of the reciprocating compressor; and supplying power to the power cut-off motor.

In the present invention, the number of windings (N) of a coil of the motor of the reciprocating compressor is varied by a micro computer (not shown) according to a load so as to vary an output capacity of the reciprocating compressor.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a block diagram showing a driving controlling apparatus for a reciprocating compressor in accordance with the prior art;

FIG. 2 is a driving circuit of a reciprocating compressor in accordance with the prior art;

FIG. 3 is a circuit diagram showing a driving controlling apparatus for a reciprocating compressor according to the present invention;

FIG. 4 is a flowchart showing a driving controlling method for a reciprocating compressor according to a first embodiment of the present invention; and FIG. 5 is a flowchart showing a driving controlling method for a reciprocating compressor according to a second embodiment of the present invention.

MODE FOR THE INVENTION

Reference will now be made in detail to the preferred embodiments of the present invention, examples of which are illustrated in the accompanying drawings.

Hereinafter, with reference to FIGS. 3 to 5, will be explained a driving controlling apparatus for a reciprocating compressor capable of stably driving a reciprocating compressor at the time of varying an output capacity of the reciprocating compressor and capable of enhancing an efficiency of the reciprocating compressor, and a method thereof.

Power to be explained hereinafter is a commercial power, and the commercial power has a substantial voltage of 220V and a frequency of 60 Hz.

FIG. 3 is a circuit diagram showing a driving controlling apparatus for a reciprocating compressor according to the present invention.

As shown in FIG. 3, the driving controlling apparatus for a reciprocating compressor according to a first embodiment of the present invention comprises: an out put capacity determining unit 31 for determining an output capacity of a reciprocating compressor; an over-stroke preventing unit 32 for preventing an over-stroke of a motor inside the reciprocating compressor; and an impedance matching unit 33 for matching an inductance of the motor inside the reciprocating compressor to an impedance of the apparatus; and a power switching device 34 for cutting off power supplied to the motor of the reciprocating compressor.

The driving controlling apparatus for a reciprocating compressor according to the present invention will be explained in more detail.

The output capacity determining unit 31 is implemented as a switching device, and selects a main coil or both the main coil and a sub coil of the motor inside the reciprocating compressor according to a load applied to the reciprocating compressor, thereby determining an output capacity of the reciprocating compressor.

The over-stroke preventing unit 32 consists of a Positive Temperature Coefficient (PTC) device and a switching device serially connected to the PTC device (for instance, a relay RY3). The over-stroke preventing unit 32 maintains an over-stroke occurring from the motor inside the reciprocating compressor as a normal stroke, the over-stroke occurring when the reciprocating compressor is driven or when an output capacity of the reciprocating compressor is varied. The switching device RY3 connected to the PTC device disconnects the PTC device from a driving circuit of the reciprocating compressor when a resistance value of the PTC device is increased due to a current flowing to the PTC device, thereby restoring the PTC device to have an initial state (initial resistance state). The impedance matching unit 33 consists of two capacitors C1 and C2, and switching devices such as RY1 and RY2 connected to the capacitors C1 and C2, respectively. The output capacity determining unit 31 selects a main coil or both the main coil and a sub coil of the motor inside the reciprocating compressor according to a load applied to the reciprocating compressor, thereby determining a size of an inductance of the reciprocating compressor. The impedance matching unit 33 consists of a CT or a pair of C1-C2 connected to each other in parallel so as to match the inductance of the reciprocating compressor to an impedance of the apparatus.

The power switching device 34 supplies power to the reciprocating compressor or cuts-off power to the reciprocating compressor. Preferably, the power switching device 34 is implemented as a relay.

Hereinafter, the operation of the driving controlling apparatus for a reciprocating compressor according to the present invention will be explained with reference to FIGS. 4 and 5. The apparatus effectively serves to vary an output capacity of the reciprocating compressor by varying a load applied to the reciprocating compressor.

FIG. 4 is a flowchart showing a driving controlling method for a reciprocating compressor according to a first embodiment of the present invention.

As shown in FIG. 4, a driving controlling method for a reciprocating compressor according to a first embodiment of the present invention comprises: cutting off power supplied to a motor of a reciprocating compressor (S41); preventing an over-stroke generated from the motor of the reciprocating compressor (S42 and S43); varying an output capacity of the reciprocating compressor (S44); matching an impedance of a driving controlling apparatus to an inductance of the motor so as to match to the varied output capacity (S45); and supplying power to the power cut-off motor (S46).

The driving controlling method for a reciprocating compressor according to a first embodiment of the present invention will be explained in more detail.

When an output capacity of the reciprocating compressor is to be varied by varying a load applied to the reciprocating compressor being operated, the power switching device 34 cuts off power supplied to the reciprocating compressor (S41).

Then, a PTC device of the over-stroke preventing unit 32 is disconnected from a driving circuit of the reciprocating compressor (S42). That is, a switching device RY3) serially connected to the PTC device is opened, thereby disconnecting the PTC device from the driving circuit of the reciprocating compressor.

After a first reference time lapses, the disconnected PTC device is re-connected to the driving circuit of the reciprocating compressor (S43). That is, the switching device (RY3) serially connected to the PTC device is closed, thereby reconnecting the PTC device to the driving circuit of the reciprocating compressor. Preferably, the first reference time is approximately 0.5 second, and can be varied.

After a second reference time lapses, the output capacity determining unit 31 varies an output capacity of the reciprocating compressor (S44). That is, the output capacity determining unit 31 selects a main coil or both the main coil and a sub coil of the motor inside the reciprocating compressor. Preferably, the second reference time is approximately 1.0 second, and can be varied.

The impedance matching unit 33 matches the inductance of the reciprocating compressor that has been varied in step S43 to an impedance of the apparatus (S45). For instance, the impedance matching unit 33 turns ON/OFF switching devices RY1 and RY2 respectively connected to two capacitors C1 and C2 serially connected to the output capacity determining unit 31, thereby serially connecting the C1 or the C1 and C2 connected to each other in parallel to the output capacity determining unit 31.

After a third reference time lapses, the power switching device 34 re-applies the cut-off power to the reciprocating compressor (S46). Preferably, the third reference time is approximately 1.0 second, and can be varied.

FIG. 5 is a flowchart showing a driving controlling method for a reciprocating compressor according to a second embodiment of the present invention.

The driving controlling method for a reciprocating compressor according to a second embodiment of the present invention comprises: cutting off power supplied to a motor of a reciprocating compressor (S51); firstly preventing an over-stroke generated from the motor of the reciprocating compressor (S52); varying an output capacity of the reciprocating compressor (S53); matching an impedance of a driving controlling apparatus to an inductance of the motor so as to match to the varied output capacity (S54); secondly preventing an over-stroke generated from the motor of the reciprocating compressor (S55); and supplying power to the power cut-off motor (S56).

The driving controlling method for a reciprocating compressor according to a second embodiment of the present invention will be explained in more detail.

When an output capacity of the reciprocating compressor is to be varied by varying a load applied to the reciprocating compressor being operated, the power switching device 34 cuts off power supplied to the reciprocating compressor (S51).

Then, the over-stroke preventing unit 32 disconnects the PTC device from a driving circuit of the reciprocating compressor (S52). That is, a switching device (RY3) serially connected to the PTC device is opened, thereby disconnecting the PTC device from the driving circuit of the reciprocating compressor.

After a fourth reference time lapses, the output capacity determining unit 31 varies an output capacity of the reciprocating compressor (S53). That is, the output capacity determining unit 31 selects a main coil or both the main coil and a sub coil of the motor inside the reciprocating compressor. Preferably, the fourth reference time is approximately 1.5 second, and can be varied.

The impedance matching unit 33 matches the inductance of the reciprocating compressor that has been varied in step S53 to an impedance of the driving controlling apparatus (S54). For instance, the impedance matching unit 33 selectively turns ON/OFF switching devices RY1 and RY2 respectively connected to two capacitors C1 and C2 serially connected to the output capacity determining unit 31, thereby serially connecting the C1 or the C1 and C2 connected to each other in parallel to the output capacity determining unit 31.

The over-stroke preventing unit 32 re-connects the disconnected PTC device to the driving circuit of the reciprocating compressor (S55). That is, the switching device (RY3) serially connected to the PTC device is closed, thereby re-connecting the PTC device to the driving circuit of the reciprocating compressor.

After a fifth reference time lapses, the power switching device 34 re-applies the cut-off power to the reciprocating compressor (S56). Preferably, the fifth reference time is approximately 1.0 second, and can be varied.

In the driving controlling method for a reciprocating compressor according to the first and second embodiments of the present invention, a voltage applied to the capacitor C1 or C2 of the impedance matching unit 33 is discharged while the reciprocating compressor is operated. Accordingly, the driving circuit of the reciprocating compressor according to the present invention can be stably maintained.

Furthermore, in the driving controlling method for a reciprocating compressor according to the first and second embodiments of the present invention, an inductance of the reciprocating compressor is matched to an impedance of a driving controlling apparatus according to a size thereof when an output capacity of the reciprocating compressor is varied. Accordingly, an optimum current flows onto the motor inside the reciprocating compressor.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

The invention claimed is:

1. A driving controlling apparatus for a reciprocating compressor, comprising: an output capacity determining unit for determining an output capacity of the reciprocating compressor; an over-stroke preventing unit for preventing an over-stroke of a motor inside the reciprocating compressor; an impedance matching unit for matching an inductance of the motor of the reciprocating compressor to an impedance of the apparatus; and a power switching device installed between the motor and a power source, for cutting off power supplied to the motor of the reciprocating compressor, wherein the over-stroke preventing unit comprises: a Positive Temperature Coefficient device for generating heat according to a current amount; and a switching device serially connected to the Positive Temperature Coefficient device, for cutting-off a current flowing to the Positive Temperature Coefficient device, and wherein the impedance matching unit comprises: two capacitors connected to each other in parallel; and switching devices respectively connected to the two capacitors.

2. The apparatus of claim 1, wherein the output capacity determining unit is connected between the motor and the impedance matching unit, and controls the output capacity by selecting a main coil or both the main coil and a sub coil of the motor by a capacity varying switch.

3. The apparatus of claim 1, wherein the over-stroke preventing unit prevents an over-stroke occurring when the reciprocating compressor is operated or the output capacity of the reciprocating compressor is varied.

4. A driving controlling method for a reciprocating compressor, comprising: cutting off power supplied to a motor of the reciprocating compressor; preventing an over-stroke generated from the motor of the reciprocating compressor; varying an output capacity of the reciprocating compressor; matching an impedance of a driving controlling apparatus to an inductance of the motor using switching devices respectively connected to capacitors so as to match to the varied output capacity; and re-supplying the power to the motor, wherein, in the cutting off power, a switching device connected between a power source and the motor is opened, and wherein the preventing an over-stroke comprises: opening a Positive Temperature Coefficient device relay serially connected to the power after cutting off the power; and closing the Positive Temperature Coefficient device relay so as to form a path of a rush current after a first reference time lapses.

5. The method of claim 4, wherein in the varying the output capacity, a capacity switching relay connected to the motor is switched after a second reference time lapses thus to select a main coil or both the main coil and a sub coil of the motor by a capacity varying switch.

6. The method of claim 4, wherein in the matching the impedance of the driving controlling apparatus, relays respectively connected to two capacitors connected in parallel are closed so as to match the impedance of the apparatus with the inductance of the motor of the reciprocating compressor.

7. The method of claim 5, wherein in the supplying power to the motor, the switching device connected between the power source and the motor is closed after a third reference time lapses.

8. A driving controlling method for a reciprocating compressor, comprising: cutting off power supplied to a motor of the reciprocating compressor; firstly preventing an over-stroke generated from the motor of the reciprocating compressor; varying an output capacity of the reciprocating compressor; matching an impedance of a driving controlling apparatus to an inductance of the motor using switching devices respectively connected to capacitors so as to match to the varied output capacity; secondly preventing an over-stroke generated from the motor of the reciprocating compressor; and re-supplying the power to the motor, wherein, in the firstly preventing an over-stroke, a Positive Temperature Coefficient device relay serially connected to the power is opened after the power is cut-off, and in the secondly preventing an over-stroke, the Positive Temperature Coefficient device relay serially connected to the power is closed so as to form a path of a rush current.

9. The method of claim 8, wherein in the varying the output capacity, a capacity switching relay connected to the motor is switched after a first reference time lapses to select a main coil or both the main coil and a sub coil of the motor by a capacity varying switch.

10. The method of claim 8, wherein in the matching the impedance, relays respectively connected to two capacitors connected in parallel are closed so as to match the impedance of the driving controlling apparatus with the inductance of the motor of the reciprocating compressor according to the variation of the output capacity.

11. The method of claim 9, wherein in the supplying power to the motor, a power switching device connected between a power source and the motor is closed after a second reference time lapses.

* * * * *